US006865781B2

(12) United States Patent
Hösel

(10) Patent No.: US 6,865,781 B2
(45) Date of Patent: Mar. 15, 2005

(54) METHOD AND APPARATUS AT A SPINNING PREPARATION MACHINE FOR CLEANING FIBER MATERIAL

(75) Inventor: Fritz Hösel, Mönchengladbach (DE)

(73) Assignee: Trutzchler GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/453,509

(22) Filed: Jun. 4, 2003

(65) Prior Publication Data

US 2004/0003485 A1 Jan. 8, 2004

(30) Foreign Application Priority Data

Jul. 8, 2002 (DE) ..... 102 30 603

(51) Int. Cl.[7] ..... D01B 3/00
(52) U.S. Cl. ..... 19/200; 19/204
(58) Field of Search ..... 19/65 R, 200, 19/202, 203, 204, 205, 97.5, 98, 105, 107, 108, 109, 65 A

(56) References Cited

U.S. PATENT DOCUMENTS

| | | | | |
|---|---|---|---|---|
| 4,530,134 A | * | 7/1985 | Hosel | 19/105 |
| 4,805,266 A | * | 2/1989 | Leifeld et al. | 19/0.2 |
| 4,977,645 A | * | 12/1990 | Hosel | 19/200 |
| 5,181,295 A | | 1/1993 | Demuth et al. | |
| 6,452,157 B1 | * | 9/2002 | Hosel | 250/227.14 |
| 6,477,741 B2 | * | 11/2002 | Hosel | 19/107 |
| 6,556,885 B2 | * | 4/2003 | Hosel | 700/139 |

FOREIGN PATENT DOCUMENTS

| | | |
|---|---|---|
| DD | 87 735 | 11/1972 |
| DE | 32 37 864 C2 | 4/1984 |
| DE | 100 63 861 A1 | 6/2002 |
| EP | 0 399 315 A1 | 11/1990 |
| EP | 0 548 023 A1 | 6/1993 |
| EP | 0 641 876 A1 | 3/1995 |
| GB | 2 151 811 | 7/1985 |
| GB | 2 316 099 | 2/1998 |

* cited by examiner

*Primary Examiner*—Gary L. Welch
(74) *Attorney, Agent, or Firm*—Venable LLP; Robert Kinberg; Edward Yee

(57) ABSTRACT

In a method at a spinning preparation machine, for example a cleaner, opener, carding machine or the like, for cleaning fiber material, especially cotton, an examination of the nature of the trash is carried out, which examination is used for adjustment of at least one adjustable cleaning element, for example a separating blade, cleaning grid or the like.

In order to make possible improved and undisrupted production by simple means, the optimum adjustment of the at least one cleaning element for a specific fiber batch is stored in a memory of an electronic control and regulation device and, when the same fiber batch is processed again, the optimum adjustment of the cleaning element is implemented automatically.

13 Claims, 4 Drawing Sheets

METHOD AND APPARATUS AT A SPINNING PREPARATION MACHINE FOR CLEANING FIBER MATERIAL

CROSS REFERENCE TO RELATED APPLICATION

This application claims priority from German Patent Application No. 102 30 603.6 which is incorporated herein by reference.

BACKGROUND OF THE INVENTION

The invention relates to a method at a spinning preparation machine, for example a cleaner, opener, carding machine or the like, for cleaning fibre material, especially cotton and further encompasses an apparatus for carrying out the method.

In a known arrangement, an examination of the nature of the trash is carried out, which examination is used for adjustment of at least one adjustable cleaning element, for example a separating blade, cleaning grid or the like.

In practice, in textile cleaning machines, especially—for example—in a pre-cleaner, the degree of cleaning is adjusted substantially with the aid of grids that can be regulated manually. This means that the amount and nature of trash material removed is dependent upon the grid positions. This also means, however, that, in the event of an incorrect adjustment, an excessive amount of good material is generally removed or else the available cleaning potential is not fully utilised. That problem arises especially when there are frequent changes of materials being processed.

In a known method (EP 0 399 315) for the operation of a system, various data have to be specified or entered into a control, including, inter alia, fibre properties, proportions of the various kinds of trash, desired degree of cleaning, production of a carded sliver. Depending on these specified data, the control is said to deliver signals by means of which adjustable opening and/or cleaning elements are so adjusted that the desired degree of cleaning and carded sliver throughput rate are achieved as a result, with any presumed fibre impairment in the cotton to be cleaned being displayed. A calculated optimisation of processing is accordingly achieved. A specific, previously entered degree of cleaning or a pre-specified throughput rate is said to be obtained. The high degree of complexity of the method is disadvantageous. In addition, it is disadvantageous that the method requires an especially high outlay in terms of system and control technology. The complexity of the method results in disruptions in the continuity of production.

SUMMARY OF THE INVENTION

It is an aim of the invention to provide a method of the type described at the beginning that avoids or mitigates the disadvantages mentioned and that especially is simple and makes possible improved and undisrupted production.

The invention provides an apparatus for cleaning fibre material at a spinning preparation machine, comprising at least one adjustable cleaning element and a control device having a memory for storing data relating to optimum adjustment of the at least one cleaning element for a specific fibre batch, the control device being in communication with at least one positioning element for effecting automatic implementation of the optimum adjustment of the at least one cleaning element when a like fibre batch is processed.

The apparatus according to the invention makes it possible, in especially simple manner, for an adjustment, once established, to be automatically reproduced again at any time. In contrast to the known method, calculated optimisation of the processing of fibre material is not carried out. For a specific fibre batch, the optimum adjustment of the cleaning element is determined in operation and stored and, when the same fibre batch is processed again, automatically retrieved. By that means, fibre material of the same provenance is optimally cleaned without loss of time and without disruption. The measures according to the invention ensure, on the one hand, that the optimum cleaning potential of the machine is always utilised and, on the other hand, that an excessive amount of good fibre material is on no account removed, or only as much as intended is removed.

Advantageously, the cleaning element is motor-adjustable. Advantageously, a trash-collecting device is provided. Advantageously, an electronic camera is associated with the trash-collecting device, which camera is in communication with an electronic evaluating unit (image-processing unit). Advantageously, determination and assessment of the trash is performed automatically. Advantageously, the evaluating device is in communication with the associated machine control. Advantageously, the optimum adjustment values are passed on to other, possibly superordinate and central systems. Advantageously, at least one opto-electronic camera is associated with each machine. Advantageously, the camera is a matrix camera. Advantageously, different light sources are provided. Advantageously, light sources of different colours are provided. Advantageously, the different colours are red light and infra-red light. Advantageously, the optimum adjustment values are used for adjusting at least one separating blade associated with a high-speed roller. Advantageously, a cleaning element is associated with a removal opening. Advantageously, the roller has a clothing. Advantageously, the at least one electronic evaluating unit (image-processing unit) is in communication with an electronic control and regulation device, for example a microcomputer. Advantageously, the machine elements such as guide vanes, separating blades and the like are automatically adjustable in dependence upon the evaluated measurement results. Advantageously, the cleaning capability of the machine is modifiable in dependence upon the evaluated measurement results. Advantageously, at least one separate camera is associated with each suction off-take location. Advantageously, a window for the camera is present in each trash-collecting line. Advantageously, a window for an illumination device is present in each trash-collecting line. Advantageously, the evaluated measurement results are used for determining the ratio of good fibre content to dirt content. Advantageously, the evaluated results are used for assessing the quality of the fibre material being processed. Advantageously, a machine is in communication with a central evaluating unit, to which more than one camera is connected. Advantageously, digital image-processing is used in the evaluating device. Advantageously, the electronic control and regulation device has, for example, a computer and a memory. Advantageously, the evaluating device is in communication with a superordinate electronic monitoring system, for example KIT. Advantageously, the measurement values of the camera are transformable into electrical signals. Advantageously, images of the trash are recorded by means of digital photodiodes. Advantageously, evaluation of the digital image information is carried out by means of image analysis software. Advantageously, the machine is in communication, by way of a communications network, with a central superordinate system control. Advantageously, in a case of repetition of a specific fibre batch for the stored pre-adjustment of cleaning elements, a visual checking device is associated with the camera system.

Advantageously, in a case of repetition of a specific fibre batch for the stored pre-adjustment of cleaning elements, a correction device for the adjustment is associated with the camera system. Advantageously, for checking, the stored data are compared with the current data. Advantageously, a malfunction or warning signalling device is activatable if there are discrepancies on comparison. Advantageously, the cleaning devices are adjusted until there is a match between stored and current data. Advantageously, current data are entered into the memory if there are discrepancies with stored data. Advantageously, a device that shields against trash, for example a deflecting plate, is associated with the camera. Advantageously, a device for an even level of trash, for example a light barrier, is provided. Advantageously, the spacing between the camera and the surface of the collected trash is the same. Advantageously, the positioning element for adjustment of the cleaning element is an electric motor. Advantageously, the electric motor is a stepper motor.

The invention also provides a method at a spinning preparation machine, for example a cleaner, opener, carding machine or the like, for cleaning fibre material, especially cotton, wherein an examination of the nature of the trash is carried out, which examination is used for adjustment of the at least one adjustable cleaning element, for example a separating blade, cleaning grid or the like, characterised in that the optimum adjustment of the at least one cleaning element for a specific fibre batch is stored in a memory of an electronic control and regulation device and, when the same fibre batch is processed again, the optimum adjustment of the cleaning element is implemented automatically. Advantageously, the optimum adjustment of the cleaning elements is determined manually. Advantageously, the optimum adjustment of the cleaning elements is determined automatically. Advantageously, the examination of the trash (trash composition) is performed visually. Advantageously, the examination of the trash (trash composition) is performed opto-electronically, for example by means of a camera. Advantageously, the optimum adjustment is determined by repeated readjustment of the cleaning elements on the basis of the examination of the trash (trash composition). Advantageously, the optimum adjustment of the cleaning elements is determined once. Advantageously, the cleaning element is motor-adjusted.

The apparatus preferably comprises a said adjustable cleaning element a grid having grid elements which are adjustable for adjusting the degree of cleaning.

DESCRIPTION OF THE PREFERRED EMBODIMENTS

Figure 1A:
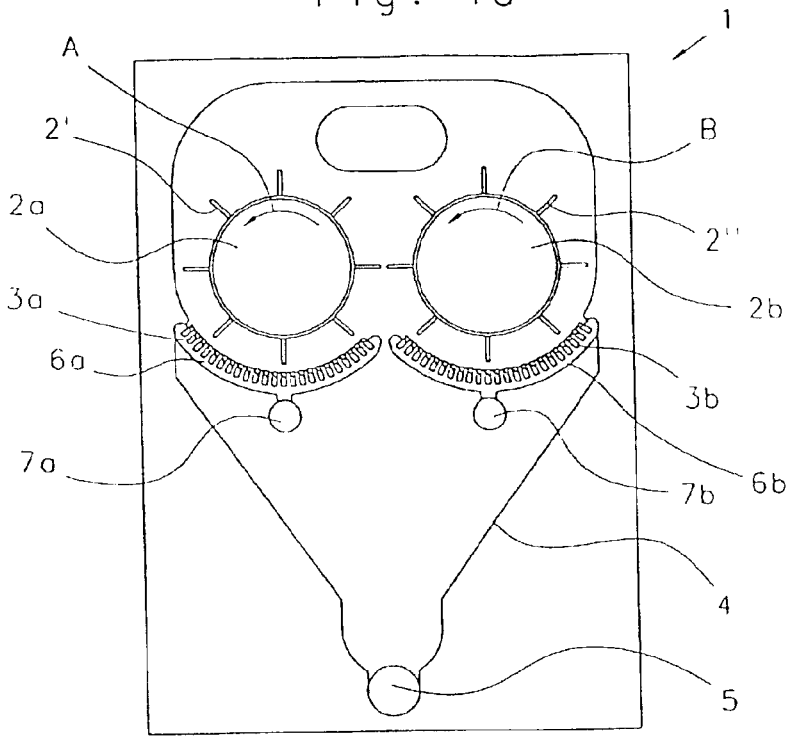
FIG. 1*a* is a diagrammatic side view of a cleaning machine having the apparatus according to the invention (motorised grid adjustment)

Referring to FIG. 1*a*, a double-roller cleaning machine 1 (axial cleaner), for example a MAXI-FLO MFC cleaner made by Trutzschler GmbH & Co of Mönchengladbach, Germany, has two rotating opener rollers 2*a*, 2*b*, underneath which there are arranged grids 3*a*, 3*b* having through-holes. The opener rollers 2*a*, 2*b* rotate anti-clockwise, in accordance with arrows A, B. The supply of the fibre material to be cleaned and the removal of the cleaned fibre material is analogous to that shown diagrammatically in FIGS. 5 and 6. Underneath the grids 3*a*, 3*b* there is a trash-collecting unit 4, which has a pneumatic trash-removing line 5. Fixed to the circumference of the opener rollers 2*a*, 2*b* are beater spikes 2', 2", which pass the supplied fibre flocks over the cleaning bars $\mathbf{3}_1$ to $\mathbf{3}_n$ of the cleaning grids 3*a*, 3*b*, which are arranged around part of the circumference of the opener rollers 2*a*, 2*b*. The position of the grid bars $\mathbf{3}_1$ to $\mathbf{3}_n$ (cleaning bars) is adjustable (see FIGS. 1*b*, 1*c*) so that, as a result, the intensity of cleaning is modified. The grid bars $\mathbf{3}_1$ to $\mathbf{3}_n$ are mounted, in the region of their bottom end, in regulating plates 6*a*, 6*b*, which can be adjusted by means of electric motors 7*a*, 7*b* (stepper motors). In this arrangement, the grid bars $\mathbf{3}_1$ to $\mathbf{3}_n$ are collectively held in the grids 3*a*, 3*b* in such a manner that, by means of one motor 7*a* or 7*b*, all the grid bars $\mathbf{3}_1$ to $\mathbf{3}_n$ in a respective group are rotated about their axes together. In the case of this adjustable bar grid 3*a*, 3*b*, the edge directed towards the opener roller 2*a*, 2*b* is sharp, the tip being positioned counter to the direction of rotation A or B.

Figure 1B:
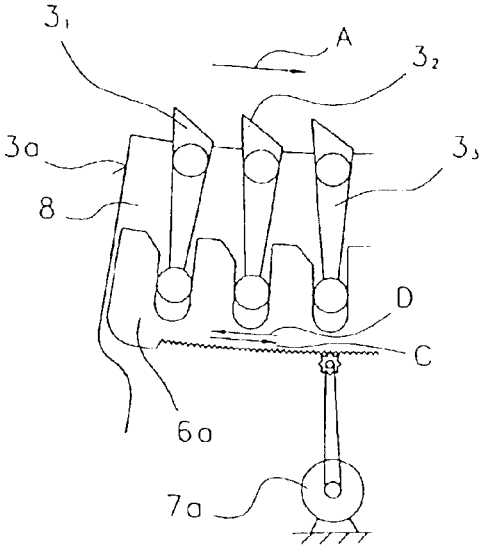
FIGS. 1*b*, 1*c* is a partial side view of the grid bars according to FIG. 1*a*, having relatively wide (1*b*) and narrow (1*c*) grid gaps.
Figure 1C:
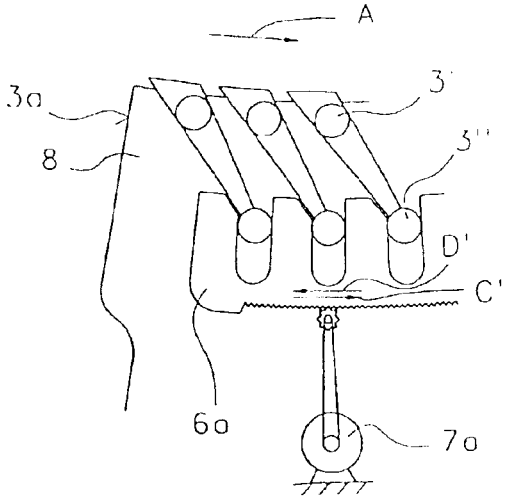

In accordance with FIGS. 1*b*, 1*c*, each grid bar $\mathbf{3}_1$ to $\mathbf{3}_n$ has, at its two ends, two cylindrical projections 3', 3" (pins). The pins 3' are fixedly mounted in a holder 8 and form the pivot point for the grid bars $\mathbf{3}_1$ to $\mathbf{3}_n$. Rotation is brought about at the pins 3" by means of the regulating plates 6*a* and 6*b*, which are rotatable about the axes of the opener rollers 2*a* and 2*b*, respectively, and which are actuated by the motors 7*a* and 7*b*, respectively, in the direction of arrow C (or, as the case may be, in the opposite direction D). FIG. 1*b* shows the grid 3*a* in the fully open state; the gaps in the grid are then open to their widest extent. The sharp edge of the grid bar is at its closest setting with respect to the roller 2*a* so that the action is at its strongest. By rotating the regulating plate 6*a* from the position of the bars $\mathbf{3}_1$ to $\mathbf{3}_n$ according to FIG. 1*b* into the position according to FIG. 1*c*, the gap becomes narrower; gradually, the sharp edge is lowered in a tangential direction so that its action becomes less and less. This apparatus provides the possibility of adjusting the grid 3*a* in accordance with the desired action.

Figure 2:
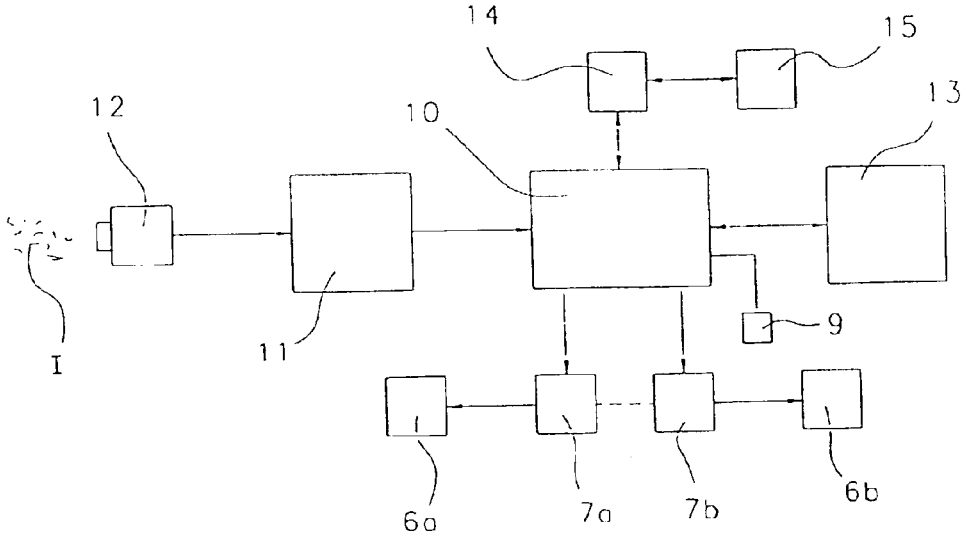
FIG. 2 is a block diagram of an electronic control and regulation device and connected camera, image-evaluating unit, operating and display unit, positioning motors and grid-adjusting elements.

In the embodiment of FIG. 2, a camera 12, for example a CCD camera is provided for examining separated trash. The camera 12, an operating and display unit 13, and the positioning motors 7*a*, 7*b* for adjustment of the regulating plates 6*a*, 6*b* are connected, by way of an image-evaluating device 11, to an electronic control and regulation device 10 (machine control), for example a microcomputer. The control and regulation device 10 is in communication with a system control 14 having an operating and display unit 15. Reference numeral 9 denotes a memory associated with the control and regulation device 10. The optimum adjustment of the cleaning grids 3*a*, 3*b* for a specific fibre batch is stored in the electronic memory 9.

Figure 3:
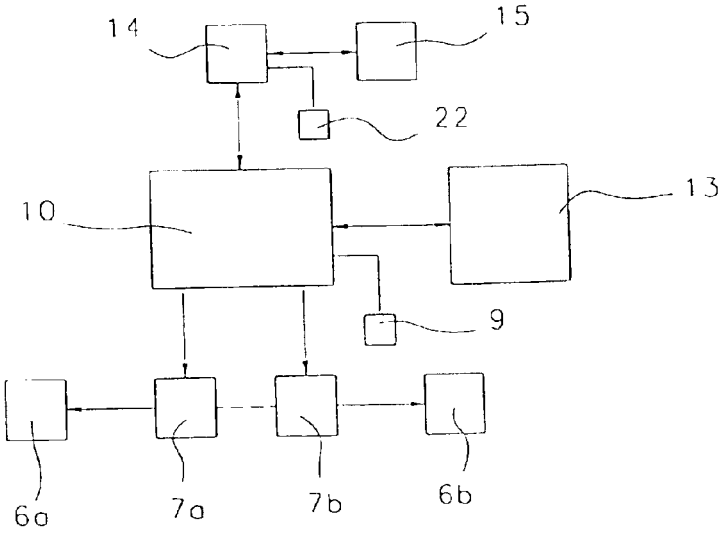
FIG. 3 is a block diagram as in FIG. 2, but without an electronic camera system.

FIG. 3 shows an embodiment which is similar to that of FIG. 2 except that no camera is present. The operating principle for regulation of the grids 3*a*, 3*b* is shown. Reference numbers 9, 10, 13, 14 and 15 have the meanings given above with reference to FIG. 2. Reference numeral 22 denotes a memory which is associated with the system control 14. In this arrangement, the memory 22 is intended for storing the optimum adjustment of at least one cleaning element 3*a*, 3*b* for a specific fibre batch.

Figure 4:
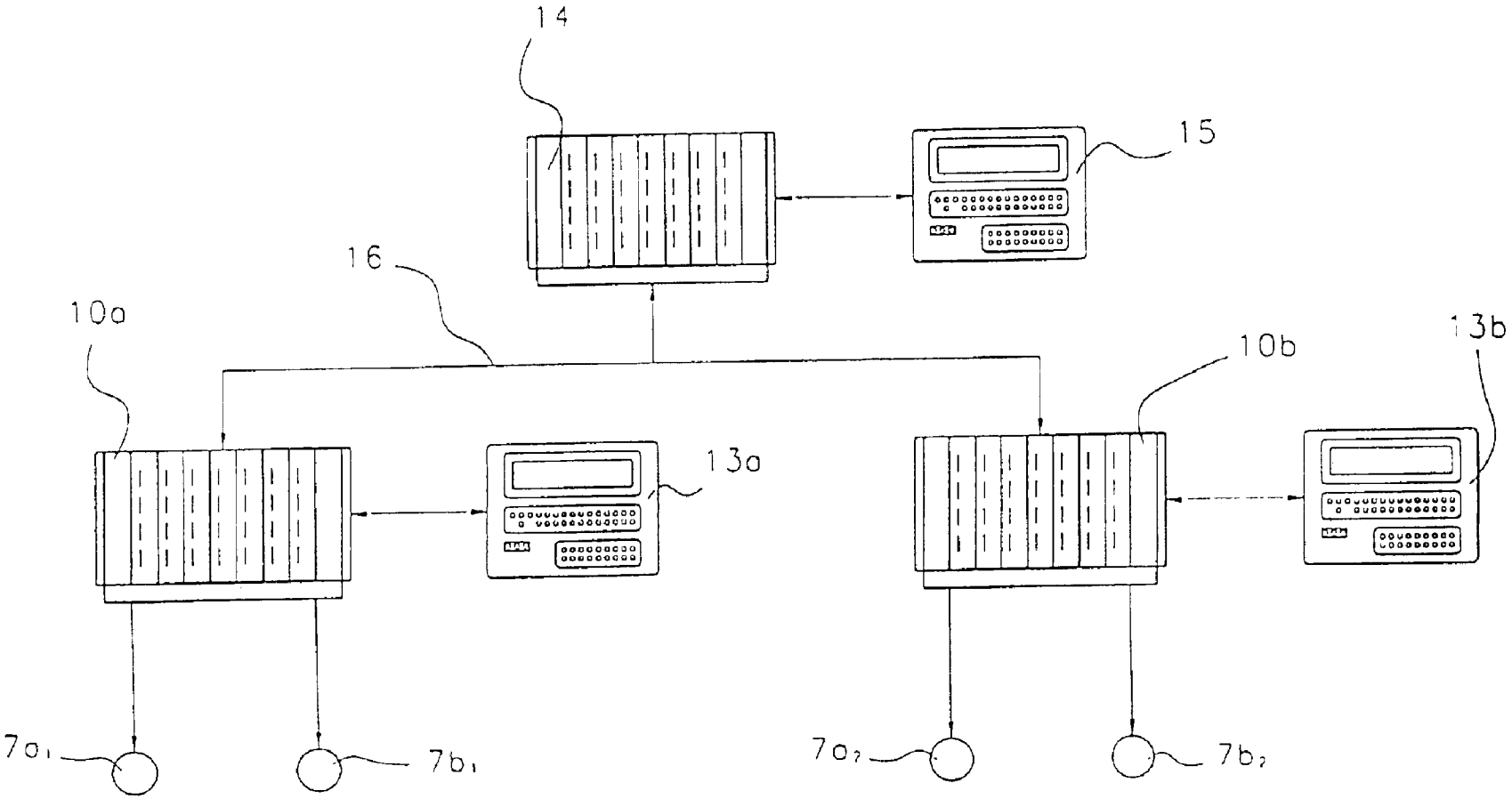
FIG. 4 is a diagrammatic representation of a production line in which the invention is implemented, having a plurality of machines coupled by way of a network and a central system control.

In accordance with FIG. 4, a plurality of machines, for example MFC cleaners of the kind already mentioned, are coupled, by way of a network 16, to the central system control 14. As machine control 10*a*, 10*b* and as system control 14 there may be provided a TMS-2 microcomputer control manufactured by Trutzschler GmbH & Co. KG of M önchengladbach, Germany. The memories 9 and 22 (see FIG. 3) are not shown separately; they are integrated into the control devices 10*a*, 10*b* and 14. Reference numeral 15 indicates an operating and display unit for system control 14, and reference numerals 13*a*, 13*b* indicate operating and display units for respective machine controls 10*a*, 10*b*.

Regulation of the grids is carried out by means of the motors 7*a*, 7*b*, which are controlled by the control 10 of machine 1. In dependence upon optimum adjustments established on one occasion for the various materials and stored in the control 10, these adjustments can be automatically produced again at any time, when required. All that is needed therefore is an entry indicating which material 17 is being processed. When such a machine 1 is connected, by way of a network 16, to a superordinate system control 14 (see FIG. 4), it is also possible for such data to be specified from there in fully automatic manner. In such a case, the optimum adjustments, once determined, are transferred from the machine 1 to the said control, where they are stored. In the event of a change of material, a large number of adjustments including, in accordance with the invention, the positions of the grids 3*a*, 3*b* are usually transferred from the system control 14 to the individual machines 1.

Analysis of the trash 19" removed, which is, to a very large extent, automatic, may be achieved by mounting one or more electronic camera systems 12, together with illumination, in the machine 1 so that automatic assessment of the trash is possible. When such a device is appropriately configured, it is possible, for example, to determine an optimum trash composition for each material, to record images thereof and to store the images and subsequently, when required, to regulate the grids 3*a*, 3*b* until the earlier images approximately match the current images. Consequently, the composition of trash 19 specified earlier is then to a very large extent re-established automatically and incorrect adjustments in all respects are substantially avoided.

If it is possible for the technological conditions relating to the good material 17 and the optimum trash 19 associated therewith to be formulated in terms of graphics or formulae, specific data for various materials pre-determined by the manufacturer can also be stored in the system, which data will then no longer need to be determined first at the customer's premises but can be retrieved directly. A further simplification is possible as a result.

An illustrative method according to the invention and the mode of operation of an above-described apparatus according to the invention may be described as follows:

1. The pre-cleaners 1 (e.g. MFC) have cleaning elements $\mathbf{3}_1$ to $\mathbf{3}_n$ capable of motorised regulation. The adjustable motors 7*a*, 7*b* are controlled by the control 10 present in the machine 1.
2. The operator observes the trash 19 being produced during operation of the machine 1. If required, he regulates the cleaning elements, for example by means of the operating keyboard of the operating and display unit 13 of the machine 1, until the trash composition corresponds to his wishes. He then reports to the machine control 10, by means of the keyboard 13, that the composition of trash currently being produced precisely corresponds to that which he desires.
3. In addition, the operator also reports to the control 10 the material 17 (or batch) to which this adjustment applies.
4. The machine control 10 then notes (memory) the positions of the regulating motors 7*a*, 7*b* and the batch to which this adjustment belongs.
5. The procedures described under points 2 to 4 are normally necessary once for each individual batch.
6. Subsequently, whenever the batch in question is processed again, it is necessary only to report to the machine control 10 that this batch is now being processed.
7. That reporting may be performed by the operator.
8. It is, however, preferable for the machine to be connected, by way of a communications network 16, to a central, superordinate system control 14 (FIGS. 3 and 4) and for the established adjustments and the associated batch name (see point 4) also to be reported, by way of the network, to the system control 14 and stored there. In this case, it is possible subsequently for the correct adjustment to be specified fully automatically, at any time, from that central location.
9. The method described above can be improved by additionally installing opto-electronic camera systems which are capable of assessing the trash 19 located in the trash compartment of the machine 1.
10. At the moment when the operator determines that the trash corresponds to his wishes and he reports that to the control (see point 2), the cameras 12 record one or more images of the trash 19; these images are evaluated by the control 10 and the determined data are stored together with the positions of the grids 3*a*, 3*b* and the relevant batch (see also points 2 to 4). Points 5 to 8 are equally valid when camera systems are used.
11. When camera systems are used, it is also possible, in a case of repetition of a specific batch for the stored pre-adjustment of cleaning elements, to carry out, in addition, visual checks and even, where required, corrections to the adjustment.
12. The checks are performed by comparing the stored data of the earlier images with the current image data.
13. If discrepancies are found during that comparison, that fact can be displayed in the form of a malfunction or warning signal (for example on the display of the operating and display unit 13).
14. In addition, it is also possible to regulate the cleaning elements $\mathbf{3}_1$ to $\mathbf{3}_n$ until a match is obtained.

Such discrepancies may come about despite the fact that, in a case of repetition, the same material is being processed again. This is due to the fact that the material being processed is a natural product, which always is subject to certain variations in respect of consistency, colour, dirt content etc.

A method according to the invention is accordingly capable of automatically carrying out reproducible adjustments and also, moreover, of automatically recognising material-specific variations and making a correction.

15. If corrections are made with respect to the originally determined adjustments, those new adjustments can likewise be stored and then, on the next change-over, can again be taken as guide values.

By this means, a continuous and automatic process of adaptation to the product in question can be carried out.

Figure 5:
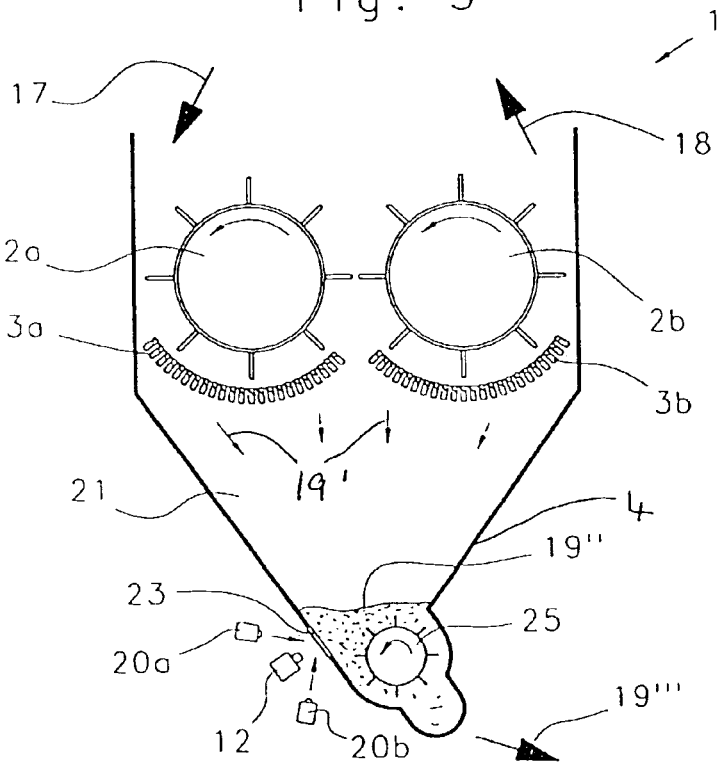
FIG. 5 is a side view of cleaning apparatus having a camera for trash monitoring, in accordance with a first arrangement.

In the embodiment of FIG. 5, a cleaner is of generally similar construction to that of FIG. 1*a* and parts indicated by reference numerals 2*a*, 2*b*, 3*a* and 3*b* have the meanings given with reference to FIG. 1*a*. Arrows 17, 18 indicate the movement of fibre material into and away from cleaner 1. A transparent window 23 is arranged in a side wall of the trash-collecting device 4, through which window the electronic camera 12 records, from the outside, the trash 19" which has been collected in the internal space 21. Two illumination devices 20*a*, 20*b* are associated with the camera 12. Reference numeral 25 indicates a roller for assisting in the feeding of collected trash 19'" for discharge as indicated by arrow 19'"

Figure 6:
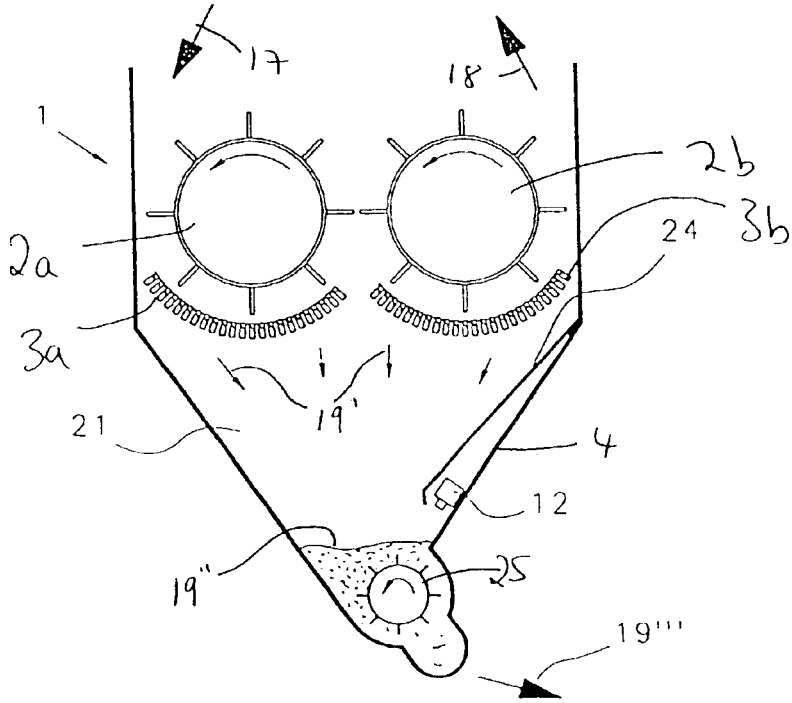
FIG. 6 is a side view of cleaning apparatus having a camera for trash monitoring, in accordance with a further arrangement.

In the embodiment of FIG. 6, the construction is the same as that of the machine in FIG. 5 except that the camera 12, including the illumination devices (not shown), is arranged inside the internal space 21, behind a protective covering 24. In both FIGS. 5 and 6, reference numeral 25 denotes a discharge roller. In both FIGS. 5 and 6, reference numeral 19' denotes the trash dropping down from the grids 3*a*, 3*b*, through the space 21; reference numeral 19" denotes the trash collected at the bottom end of the trash-collecting device 4; and 19'" denotes the trash discharged, and preferably drawn off under suction, from the trash-collecting device 4.

Depending on which camera position is selected (for example, in accordance with FIG. 6), a device will typically be provided which ensures that the level of trash 19" remains the same, for example a light barrier or any other form of device suitable for maintaining and controlling the trash level. This may be necessary because the cameras 12 usually have only a limited depth of field.

What is claimed is:

1. An apparatus for cleaning fibre material at a spinning preparation machine, comprising at least one adjustable cleaning element that comprises a grid having grid elements which are adjustable for adjusting the degree of cleaning, and a control device having a memory for storing data relating to optimum adjustment of the at least one cleaning element for a specific fibre batch, the control device being in communication with at least one positioning element for effecting automatic implementation of the optimum adjustment of the at least one cleaning element when a like fibre batch is processed.

2. An apparatus according to claim 1, further comprising a trash-collection device for collecting trash removed from the fibre at said cleaning element, the trash-collecting device including a trash-monitoring device for monitoring trash in the trash-collecting device.

3. An apparatus according to claim 2, in which the trash-monitoring device is in communication with an evaluation unit for evaluation of the trash.

4. An apparatus according to claim 3, in which the trash-monitoring device is a camera.

5. An apparatus according to claim 4, in which the trash-monitoring device comprises one or more light sources.

6. An apparatus according to claim 1, in which one or more said cleaning elements are adjustable automatically in dependence upon evaluation of trash removed at said at least one adjustable cleaning element.

7. An apparatus according to claim 1, comprising image analysis software for analysis of images of the trash.

8. An apparatus according to claim 1, in which current data relating to trash removed at a cleaning element can be compared with stored data relating to trash removed at that cleaning element.

9. An apparatus according to claim 1, in which the positioning element for adjustment of said at least one adjustable cleaning element is an electric motor.

10. A method of removing trash at a spinning preparation machine, comprising removing trash at at least one adjustable cleaning element, determining optimum adjustment conditions for said at least one adjustable cleaning element for a given fibre batch, storing said optimum adjustment conditions in a memory of a control device, and effecting automatic implementation of said optimum adjustment conditions in response to an indication to said control device that a like fibre batch is to be processed, wherein the optimum adjustment conditions comprise a positioning of grid elements of a grid, the grid elements being adjustable for adjusting the degree of cleaning.

11. A method according to claim 10, in which said optimum adjustment conditions are determined manually.

12. A method according to claim 10, in which said optimum adjustment conditions are determined automatically.

13. A method according to claim 10, in which said optimum adjustment conditions are determined by means of adjusting the positioning of said at least one adjustable cleaning element, and monitoring trash separated at said at least one adjustable cleaning element.

* * * * *